US007615266B2

(12) United States Patent
Kinoshita et al.

(10) Patent No.: US 7,615,266 B2
(45) Date of Patent: Nov. 10, 2009

(54) INK JET RECORDING MATERIAL

(75) Inventors: Shuzo Kinoshita, Tokyo (JP); Yukio Tokunaga, Tokyo (JP); Masako Horai, Nagano-ken (JP); Hiroyuki Onishi, Nagano-ken (JP); Masaya Shibatani, Nagano-ken (JP)

(73) Assignee: Eiko Epson Corporation, Tokyo (JP)

( * ) Notice: Subject to any disclaimer, the term of this patent is extended or adjusted under 35 U.S.C. 154(b) by 188 days.

(21) Appl. No.: 11/384,047

(22) Filed: Mar. 17, 2006

(65) Prior Publication Data

US 2006/0216443 A1 Sep. 28, 2006

(30) Foreign Application Priority Data

Mar. 22, 2005 (JP) ..... 2005-081422

(51) Int. Cl.
*B41M 5/40* (2006.01)

(52) U.S. Cl. ..... 428/32.33; 428/32.18; 428/32.21; 428/32.22; 428/32.34

(58) Field of Classification Search ..... 428/32.18, 428/32.21, 32.22, 32.34, 32.33
See application file for complete search history.

(56) References Cited

U.S. PATENT DOCUMENTS

| | | | | |
|---|---|---|---|---|
| 6,242,082 | B1 * | 6/2001 | Mukoyoshi et al. | 428/32.18 |
| 6,244,701 | B1 | 6/2001 | Moriya et al. | |
| 6,610,389 | B2 * | 8/2003 | Ishimaru et al. | 428/195.1 |
| 7,060,342 | B2 | 6/2006 | Moriya et al. | |
| 2003/0224129 | A1 * | 12/2003 | Miyachi et al. | 428/32.1 |
| 2004/0121093 | A1 * | 6/2004 | Ogino et al. | 428/32.1 |

FOREIGN PATENT DOCUMENTS

| | | |
|---|---|---|
| EP | 0 770 493 | 1/2000 |
| EP | 1 138 509 | 10/2001 |
| JP | 7-156535 | 6/1995 |
| JP | 8-337047 | 12/1996 |
| JP | 9-119093 | 5/1997 |
| JP | 9-183266 | 7/1997 |
| JP | 2001-310547 | 11/2001 |
| JP | 2002-86904 | 3/2002 |
| JP | 2002-219857 | 8/2002 |
| JP | 2003-159862 | 6/2003 |
| JP | 2003-312134 | 11/2003 |
| JP | 2004-122710 | 4/2004 |
| JP | 2004-174729 | 6/2004 |

OTHER PUBLICATIONS

Patent Abstracts of Japan and JPO computer generated English translation of JP 2001-310547 dated Nov. 6, 2001.
Patent Abstracts of Japan and JPO computer generated English translation of JP 2002-86904 dated Mar. 26, 2002.
Patent Abstracts of Japan and JPO computer generated English translation of JP 2003-159862 dated Jun. 3, 2003.
Patent Abstracts of Japan and JPO computer generated English translation of JP 2004-122710 dated Apr. 22, 2004.
Patent Abstracts of Japan and JPO computer English translation of JP 2004-174729 dated Jun. 24, 2004.
Patent Abstracts of Japan and JPO computer English translation of JP 7-156535 dated Jun. 20, 1995.
Patent Abstracts of Japan and JPO computer English translation of JP 2002-219857 dated Aug. 6, 2002.
Patent Abstracts of Japan and JPO computer English translation of JP 9-183266 dated Jul. 15, 1997.
Patent Abstracts of Japan and JPO computer English translation of JP 2003-312134 dated Nov. 6, 2003.

* cited by examiner

*Primary Examiner*—Betelhem Shewareged
(74) *Attorney, Agent, or Firm*—Ladas and Parry LLP

(57) ABSTRACT

An ink jet recording material of the invention includes a polyolefin resin-covered paper substrate, an ink absorption layer and a layer principally including colloidal silica in this order at one face of the substrate, and a backcoat layer at an opposite face of the substrate. An MD direction Taber stiffness of the substrate is at least 3 mN·m. The ink absorption layer principally includes fumed silica, and the backcoat layer is principally polyurethane resin. The ink absorption layer includes a thioether-based compound, and a polyolefin resin layer at a side of the substrate at which the ink absorption layer is to be provided includes an fluorescent brightening agent and a white pigment. A solid content coating amount of the colloidal silica is 0.05 to 0.3 g/m$^2$, and a solid content coating amount of the polyurethane resin is 0.8 to 1.5 g/m$^2$. A 20° glossiness of a blank portion of a face of the recording material that features the ink absorption layer is 40 to 60%.

5 Claims, No Drawings

INK JET RECORDING MATERIAL

CROSS-REFERENCES

The entire disclosure of Japanese Patent Application No. 2005-81422, filed Mar. 22, 2005, is expressly incorporated by reference herein.

BACKGROUND

1. Technical Field

The present invention relates to an ink jet recording material which is more excellent in high-quality feel (touch feel and texture), gloss, color reproduction, and preservation stability of blank portions and printed portions than previous ink jet recording materials, which is excellent in applicability to printing with both dye-based inks and pigment-based inks, and which is excellent for printer conveyance precision.

2. Related Art

In recent years, with the spread of digital cameras, digital photo images have become commonplace and ink jet printers, which are suitable for printing digital photo images, have also rapidly spread. Ink jet recording papers in which an ink absorption layer, a principal component of which is microscopic inorganic microparticles, is provided on a substrate formed of polyolefin resin-covered paper (a substrate in which both faces of a base paper are laminated with a polyolefin resin such as polyethylene or the like) are known and have been marketed as recording materials which are suitable for the printing of photo images.

Now, recording papers with further improvements in glossiness, high-quality feel (touch feel and texture), whiteness, color reproduction characteristics, preservation stability of blank portions and printed portions, and so forth are sought by the market. However, recording papers which have been used hitherto have not achieved satisfactory levels in all these characteristics together.

Meanwhile, it is known that preservation characteristics of printed images (light resistance, gas resistance, etc.) are improved by using pigment-based inks instead of dye-based inks. However, recording papers which are excellent in applicability to printing with dye-based inks have not been satisfactory in applicability to pigment-based inks. For example, there have been problems in that images have a subdued appearance at high-density portions (glossiness is lowered for a dulled appearance) and in that color expression is poor in comparison with dye-based inks. Consequently, recording papers which, in addition to being excellent in high-quality feel (touch feel and texture), whiteness and color reproduction as described above, are excellent in applicability to printing with both dye-based inks and pigment-based inks are sought.

As a technique for raising glossiness of a recording paper, providing a colloidal silica layer at a topmost layer is known. This is described in, for example, JP-A-2003-159862 and the like. An ink jet recording paper in which a Taber stiffness of the substrate is prescribed has been disclosed in JP-A-2004-122710. An ink jet recording paper which includes an fluorescent brightening agent and a white pigment in a thermoplastic resin layer of the substrate has been disclosed in JP-A-2001-310547. Furthermore, including a thioether-based compound in an ink absorption layer has been disclosed in JP-A-2002-86904 and the like.

However, the recording papers described in the above patent references have not been satisfactory in regard to the various above-mentioned characteristics all together.

SUMMARY

According to an aspect of the invention, an ink jet recording material 1) is an ink jet recording material including: a polyolefin resin-covered paper substrate; an ink absorption layer principally including fumed silica and a layer principally including colloidal silica, in this order at one face of the substrate; and a backcoat layer principally of polyurethane resin at an opposite face of the substrate. An MD direction Taber stiffness of the substrate is at least 3 mN·m. The ink absorption layer includes a thioether-based compound, and a polyolefin resin layer at a side of the substrate at which the ink absorption layer is to be provided includes an fluorescent brightening agent and a white pigment. A solid content coating amount of the colloidal silica is 0.05 to 0.3 g/m$^2$, and a solid content coating amount of the polyurethane resin is 0.8 to 1.5 g/m$^2$. A 20° glossiness of a blank portion of a face of the recording material that features the ink absorption layer is 40 to 60%. 2) It is preferable that a basis weight of a base paper of the polyolefin resin-covered paper substrate is 190 to 230 g/m$^2$.

An advantage of some aspects of the invention is the provision of an ink jet recording material which is excellent in high-quality feel (touch feel and texture), gloss, color reproduction, and preservation stability of blank portions and printed portions, which is excellent in applicability to printing with both dye-based inks and pigment-based inks, and which is moreover excellent for printer conveyance precision.

DESCRIPTION OF EXEMPLARY EMBODIMENTS

An ink jet recording material according to an aspect of the invention is provided with polyolefin resin-covered paper, which serves as a substrate. The polyolefin resin-covered paper (hereafter referred to simply as resin-covered paper) is a paper in which both faces of a base paper are covered with polyolefin resin layers. The resin-covered paper has a Taber stiffness in an MD direction of at least 3 mN·m. Herein, the Taber stiffness is measured in accordance with ISO-2493, and the MD direction means a direction of flow during papermaking of the base paper.

If the Taber stiffness of the resin-covered paper is less than 3 mN·m, texture will be insufficient and a recording material with a high-quality feel will not be provided. Further, if the Taber stiffness is excessively large, problems may arise with printer conveyance characteristics. Therefore, 5 mN·m or less is preferable. The Taber stiffness is more preferably 3.5 to 4.5 mN·m. Adjustment of the MD direction Taber stiffness of the resin-covered paper can be implemented by adjusting a basis weight or density of the base paper, a type of pulp, types and addition amounts of additives, and so forth. High-quality feel for this invention means a combination of texture due to Taber stiffness and a pleasant, silky touch feel due to a layer which principally includes colloidal silica. A high-quality feel can be obtained by achieving both of these.

A basis weight of the base paper that is used for the resin-covered paper is preferably in the range of 190 to 230 g/m$^2$. Hence, texture of the recording material is further enhanced. As a pulp for constituting the base paper, one or a mixture of two or more types of natural pulp, recycled pulp, synthetic pulp and the like is used. Smooth base papers (original papers) as used for resin-covered paper substrates for photographic printing papers can be preferably used. Additives which are used in general papermaking, such as a sizing agent, a paper-strengthening agent, a filler, an anti-static agent, an anchor agent, a dye and the like, are suitably blended with the base paper. It is preferable to perform a surface-smoothing treatment, such as compression by application of pressure with a calender or the like, or the like, during papermaking or after papermaking of the base paper.

An ink absorption layer of the recording material is provided at one face of the resin-covered paper. The polyolefin resin layer at a side at which the ink absorption layer is to be provided contains white pigment and an fluorescent brightening agent. As a result, whiteness of the ink absorption layer side is improved. Whiteness of the polyolefin resin layer surface is preferably at least 95% and more preferably at least 97%. Whiteness can be measured with, for example, a WMS-1, manufactured by Murakami Color Research Laboratory Co., Ltd., in accordance with ISO-2470. It is preferable to regulate types, additive amounts, etc. of the white pigment and the fluorescent brightening agent so as to achieve whiteness as described above.

The ink absorption layer and a layer thereabove are principally constituted by fumed silica and colloidal silica. These inorganic microparticles have higher transparency than other inorganic microparticles. Therefore, whiteness of a recording material surface is greatly influenced by the substrate. Whiteness of the recording surface of the recording material is increased by preemptively raising the whiteness of the substrate, and color reproduction characteristics are improved.

When an fluorescent brightening agent is included in an ink absorption layer in order to raise whiteness of a recording surface, problems may occur with discoloration of blank portions during storage due to trace gases in the atmosphere (ozone, nitrogen compounds and the like). This problem is solved by including the fluorescent brightening agent in the polyolefin resin layer of the resin-covered paper. Hence, because the white pigment and the fluorescent brightening agent are included in combination in the polyolefin resin layer, there are advantages in that whiteness of the recording surface (the ink absorption layer face) is raised and color reproduction characteristics are improved, and at the same time preservation stability (gas resistance) of blank portions can be assured.

For the fluorescent brightening agent to be included in the polyolefin resin layer, publicly-known fluorescent brightening agents can be used. Examples include bis(benzoxazolyl) stilbene types, dimethylstilbene types, diaminostilbene types, bis(benzoxazolyl)naphthalene types, bis(oxazolyl)thiophene types, imidazole types, benzimidazole types, thiazole types, oxazole types, triazole types, oxadiazole types, thiadiazole types, naphthalimide types, pyrazolin types, pyrene types, imidazolone types and so forth. The fluorescent brightening agent is preferably capable of resisting high temperatures, for being melt-extruded together with the polyolefin resin at a high temperature, and resistant to the incidence of bleeding over time. Accordingly, fluorescent brightening agents of bis (benzoxazolyl)stilbene types and bis(benzoxazolyl)naphthalene types can be preferably used as the fluorescent brightening agent.

Specific examples are shown below.

(1) 4,4'-bis(benzoxazole-2-yl)stilbene
(2) 4, 4'-bis(6-methyl-benzoxazole-2-yl)stilbene
(3) 4,4'-bis(6-ethyl-benzoxazole-2-yl)stilbene
(4) 4,4'-bis(6-t-butyl-benzoxazole-2-yl)stilbene
(5) 4,4'-bis(6-methoxy-benzoxazole-2-yl)stilbene
(6) 4,4'-bis(6-phenyl-benzoxazole-2-yl)stilbene
(7) 4,4'-bis(5,6-dimethyl-benzoxazole-2-yl)stilbene
(8) 4,4'-bis(5,6-diethyl-benzoxazole-2-yl)stilbene
(9) 1,4'-bis(benzoxazole-2-yl)naphthalene
(10) 1,4'-bis(6-methyl-benzoxazole-2-yl)naphthalene
(11) 1 ,4'-bis(6-ethyl-benzoxazole-2-yl)naphthalene
(12)1 ,4'-bis(6-phenyl-benzoxazole-2-yl)naphthalene
(13)1 ,4'-bis(5,6-dimethyl-benzoxazole-2-yl)naphthalene
(14) 1,4'-bis(5,6-diethyl-benzoxazole-2-yl)naphthalene An inclusion amount of the fluorescent brightening agent in the polyolefin resin layer is preferably 0.02 to 0.10% by weight relative to the polyolefin resin, and more preferably 0.04 to 0.08% by weight.

As the white pigment to be included in the polyolefin resin layer, titanium oxide is preferable in regard to whiteness, dispersibility and the like. The titanium oxide may have a rutile form or an anatase form, of which one or a mixture may be used.

A mean particle diameter of the white pigment is preferably 0.1 to 0.5 μm in regard to whiteness and gloss. An inclusion amount of the white pigment in the polyolefin resin layer is preferably around 5 to 20% by weight relative to the polyolefin resin.

In addition to the fluorescent brightening agent and the white pigment, it is preferable to suitably combine various additives into the polyolefin resin layer of the resin-covered paper, such as: a blue pigment or dye such as cobalt blue, ultramarine, sicilian blue, phthalocyanine blue or the like; a magenta pigment or dye such as cobalt violet, fast violet, manganese violet or the like; an ultraviolet absorbent; an antioxidant; and so forth.

A polyolefin resin to be used in the polyolefin resin layer is an olefin homopolymer, such as a low-density polyethylene, high-density polyethylene, polypropylene, polybutene, polypentene or the like, a copolymer formed of two or more olefins, such as an ethylene-propylene copolymer or the like, or a mixture of these. Polyolefin resins with various densities and melt viscosity indexes (melt indexes) can be used singly or mixed. Among these, polyethylene resins are particularly preferably used.

In the polyolefin resin layer at the side at which the ink absorption layer is to be provided, it is preferable to use a low-density polyethylene resin, with a density of not more than 0.930 g/cm$^3$, as at least 90% by weight of all resin, more preferably 100% by weight. Further, in the polyethylene resin layer at the opposite side from the ink absorption layer, it is preferable to use a high-density polythene resin, with a density of not less than 0.950 g/cm$^3$, as at least 30% by weight of all resin, and more preferably at least 50% by weight, with an upper limit being around 95% by weight.

A solid content coating amount of the polyolefin resin layer at the side of the resin-covered paper to which the ink absorption layer is to be applied is preferably 20 g/m$^2$ to 45 g/m$^2$, and more preferably 25 g/m$^2$ to 40 g/m$^2$. A solid content coating amount of the polyolefin resin layer at the face opposite from the ink absorption layer is preferably 20 g/m$^2$ to 40 g/m$^2$ and more preferably 25 g/m$^2$ to 35 g/m$^2$.

It is preferable to provide the resin-covered paper with an undercoat layer at the face at which the ink absorption layer is to be applied. This undercoat layer is coated onto the polyolefin resin layer surface and dried beforehand, prior to application of the ink absorption layer, and principally contains a water-soluble polymer, polymer latex or the like that is capable of forming a film. Water-soluble polymers such as gelatin, polyvinyl alcohol, polyvinyl pyrrolidone, water-soluble cellulose and the like are preferable, and gelatin is particularly preferable. It is also preferable to include a surfactant, a film-hardening agent and the like in the undercoat layer.

The recording material features a backcoat layer, which principally contains polyurethane resin, at the opposite face of the resin-covered paper substrate. Herein, principally containing polyurethane resin means containing at least 50% by weight relative to a total solid content of the backcoat layer. 70% by weight or more is preferable, and 80% by weight or more is more preferable. Because the backcoat layer which is principally polyurethane resin is provided, conveyance precision in printers is improved.

A coating amount of the backcoat layer has a polyurethane resin solid component of 0.8 g/m$^2$ to 1.5 g/m$^2$, and a range of 1 g/m$^2$ to 1.3 g/m$^2$ is more preferable. If the coating amount of the backcoat layer is less than 0.8 g/m$^2$, printer conveyance precision will not be obtained, and if the coating amount is greater than 1.5 g/m$^2$, it may not be possible to maintain curl balance in low humidity environments and high humidity environments.

The polyurethane resin contained in the backcoat layer preferably has a glass transition temperature (Tg) in the range of 35 to 100° C., and a range of 40 to 80° C. is more preferable. If the Tg is lower than 35° C., printer conveyance characteristics will deteriorate, and if the Tg is over 100° C., printer conveyance precision will be lowered, which would not be preferable. Here, printer conveyance characteristics means non-occurrence of problems with recording sheets being multiply fed (two sheets being conveyed together), or not being conveyed at all. Printer conveyance precision means recording sheets being accurately conveyed in correspondence with a head speed. If conveyance precision is poor, banding (horizontal stripes) will occur, and problems such as a printing end position being mispositioned relative to the recording sheet will occur.

The polyurethane resin may be, for example, a water dispersion-type polyurethane resin, such as the VONDIC series from Dainippon Ink and Chemicals, Incorporated, or a water-based polyurethane resin, such as the HYDRAN series from Dainippon Ink and Chemicals, Incorporated. These can be used singly or in a mixture of two or more.

The backcoat layer may also contain an anti-static agent, a surfactant, a curing agent, a colorant, an antioxidant, a pH regulator, a preservative and so forth. In consideration of printer conveyance abrasions at a time of continuous printing by a printer, it is preferable if pigment particles are not included.

The ink jet recording material features the ink absorption layer, which principally includes fumed silica, at one face of the resin-covered paper substrate. Herein, principally including fumed silica means containing fumed silica as at least 50% by weight relative to total solid content of the ink absorption layer. Including 60% by weight or more is preferable, and including a range of 65 to 95% by weight is more preferable.

Fumed silica is produced by a flame hydrolysis method. Specifically, a method of production by burning silicon tetrachloride together with hydrogen and oxygen is commonly known. However, in place of silicon tetrachloride, it is possible to utilize a silane, such as methyl trichlorosilane or the like, singly or having been mixed with silicon tetrachloride. Fumed silica is commercially available and can be obtained as AEROSIL from Nippon Aerosil Co., Ltd. or a QS type from Tokuyama Corporation.

The fumed silica is preferably dispersed to a mean linear particle diameter of 30 nm or less and a mean square particle diameter of 400 nm or less. In order to provide higher ink absorption and glossiness, it is preferable if fumed silica with a mean linear particle diameter of 3 nm to 20 nm is dispersed to a mean square particle diameter of 30 nm to 300 nm.

The mean linear particle diameter of the fumed silica is a mean particle diameter found from particle diameters which are diameters of circles with equivalent projected areas of each of 100 particles, which are present in a certain area, by observation with an electron microscope of particles which have been dispersed to an extent such that the linear diameters can be discerned. The mean square particle diameter is a value found by measuring a dilute dispersion with a laser diffraction/scattering-type particle size distribution measurement apparatus.

A solid content coating amount of the ink absorption layer is preferably in a range of 20 g/m$^2$ to 40 g/m$^2$, and a range of 22 g/m$^2$ to 30 g/m$^2$ is more preferable.

A thioether-based compound is included in the ink absorption layer. Consequently, preservation characteristics of printed portions (color-fading due to trace gases such as ozone, nitrogen compounds and the like in the atmosphere) are improved. As the thioether-based compound, a compound represented by the following general formula (1) can be preferably used.

$$R1\text{-}(S\text{-}R3)_m\text{-}S\text{-}R2 \qquad \text{General Formula (1)}$$

In general formula (1), R1 and R2 each independently represent a hydrogen atom, an alkyl group or an aromatic group. R1 and R2 may be the same or different, and may bond to form a ring. At least one of R1 and R2 is an alkyl group which is substituted with a hydrophilic group, such as an amino group, an amide group, an ammonium group, a hydroxy group, a sulfo group, a carboxy group, an aminocarbonyl group, an aminosulfonyl group or the like, or is an aromatic group. R3 may be substituted and, depending on the case, represents an alkylene group including an oxygen atom. m represents an integer from 0 to 10. If m is 1 or more, one or more of sulfur atom bonding with R3 may be a sulfonyl group.

As this thioether-based compound, 3-thia-1,5-heptanediol, 4-thia-1,7-pentanediol, 3,6-dithia-1,8-octanediol, 3,6,9-trithia-1,11-undecanediol, 3,9-dithia-6-oxa-1,11-undecanediol, methylene bis(thioglycolate), bis[2-(2-hydroxyethylthio)ethyl]sulfone and the like can be considered.

An inclusion amount of the thioether-based compound is preferably in the range of 0.5 to 50% by weight relative to total solid content of the ink absorption layer, and is more preferably in the range of 1 to 40% by weight.

It is preferable to select and use a hydrophilic binder in the ink absorption layer, with a view to providing higher transparency and higher ink permeability. When a hydrophilic binder is utilized, it is important that the hydrophilic binder does not swell and close up cavities at a time of initial permeation of ink. In this regard, a hydrophilic binder with a comparatively low degree of swelling in the vicinity of room temperature is preferably used. A preferable hydrophilic binder is a wholly or partially saponified polyvinyl alcohol or a cation-denatured polyvinyl alcohol.

A cation-denatured polyvinyl alcohol means, as described in, for example, JP-A-61-10483, a polyvinyl alcohol which includes a primary, secondary ortertiary amino group, a quaternary ammonium group or the like at a main chain or a side chain of a polyvinyl alcohol.

Among polyvinyl alcohols, those which are partially saponified to a degree of saponification of 80% or more or are completely saponified are preferable. A polyvinyl alcohol with an average degree of polymerization of 500 to 5,000 is preferable. With regard to coating characteristics and ink absorbence of the ink absorption layer, a polyvinyl alcohol with an average degree of polarization of 3,000 to 4,000 is preferable.

A ratio of the hydrophilic binder to the fumed silica in the ink absorption layer is preferably in the range of 10 to 30% by weight, and more preferably in the range of 12 to 25% by weight.

It is preferable to include a boron-containing compound with the hydrophilic binder in the ink absorption layer, to serve as a film-hardening agent. Boric acid, borates, borax and the like are available as boron-containing compounds, and these can be used singly or in a combination of two or more. Borates include orthoborates, metaborates, diborates, tetraborates, pentaborates and the like.

It is preferable to use a water-soluble aluminium compound in the ink absorption layer to serve as an ink-fixing agent, in order to further improve water resistance of dye-based inks. As such a compound, a basic polyhydrated aluminium compound can be preferably used. A principal component of this compound is shown by the following formula 1, 2 or 3, and is, for example, a water-soluble polyhydrated aluminium which stably includes multinucleic condensed ions of a polymer with a basic group, such as $[Al_6(OH)_{15}]^{3+}$, $[Al_8(OH)_{20}]^{4+}$, $[Al_{13}(OH)_{34}]^{5+}$, $[Al_{2+}(OH)_{60}]^{3+}$ or the like.

$$[Al_2(OH)_nCl_{6-n}]_m \quad \text{Formula 1}$$

$$[Al(OH)_3]_nAlCl_3 \quad \text{Formula 2}$$

$$Al_n(OH)_mCl_{(3n-m)} 0<m<3n \quad \text{Formula 3}$$

These compounds are marketed by Taki Chemical Co., Ltd., as a water treatment chemical under the name polyaluminium chloride (PAC), by Asada Chemical Co., Ltd. under the name polyaluminium hydroxide (Paho), by Riken Green Co., Ltd. under the name PURACHEM WT, and from other makers with similar objectives, and various grades can be easily obtained. These products may be used as supplied.

A usage amount of this ink-fixing agent is preferably in the range of 2% by weight to 6% by weight relative to the fumed silica, and is more preferably in the range of 3% by weight to 5% by weight.

Beside a film-hardening agent and an ink-fixing agent, various publicly-known additives can be added to the ink absorption layer, such as a surfactant, an ultraviolet absorbent, an antioxidant, a pigment dispersant, an antifoaming agent, a leveling agent, a preservative, a viscosity stabilizer, a pH regulator and so forth.

The ink jet recording material features a layer which principally includes colloidal silica (hereafter referred to as a colloidal silica-containing layer) over the ink absorption layer. Herein, principally including colloidal silica means including at least 70% by weight of colloidal silica relative to total solid content of the layer. Including 80% by weight or more is preferable, and including 90% by weight or more is more preferable.

The colloidal silica-containing layer is preferably provided as a topmost layer. Hence, glossiness is further improved, and a pleasant, silky touch feel is provided. In particular, if this layer is formed as a thin layer with a solid content coating amount of colloidal silica being 0.3 g/m$^2$ or less, excellent glossiness and touch feel will be provided while maintaining high ink absorbence and, moreover, ameliorating dulling (loss of glossiness) of high-density image portions in a case of printing with pigment-based inks. A lower limit of the solid content coating amount of the colloidal silica is 0.05 g/m$^2$, satisfactory glossiness and touch feel being provided if the solid content amount of colloidal silica is not less than 0.05 g/m$^2$. The solid content coating amount of colloidal silica is preferably 0.1 to 0.25 g/m$^2$.

For the colloidal silica, sodium silicate is multiply decomposed with an acid or the like, or passed through an ion exchange resin layer or the like, to provide a silica sol, the silica sol is heat-matured to provide silicon dioxide, and the silicon dioxide is dispersed in water in colloid form. In consideration of gloss of blank portions and ink absorbence, the colloidal silica preferably has a mean linear particle diameter of 20 nm to 80 nm, more preferably 20 to 60 nm.

Colloidal silica is marketed as PL-10A, PL-3L, PL-1 and the like from Fuso Chemical Co., Ltd. and as SNOWTEX ST-20, ST-30, ST-40, ST-C, ST-N, ST-20L, ST-O, ST-OL, ST-S, ST-XS, ST-XL, ST-YL, ST-ZL, ST-OZL, ST-UP, ST-OUP, ST-PS-MO and the like from Nissan Chemical Industries, and can be easily obtained.

In the layer which principally contains colloidal silica, it is additionally possible to include a hydrophilic binder, a surfactant, a pH regulator and so forth. With regard to ink absorbence, a content amount of a hydrophilic binder is preferably not more than 5% by weight relative to the colloidal silica, and non-addition thereof is more preferable.

A 200 glossiness of a blank portion of a recording face of the ink jet recording material (the face featuring the ink absorption layer) is 40 to 60%, and is preferably 45 to 55%. Herein, the 200 glossiness is a value measured in accordance with JIS-Z8741. Such a degree of glossiness of the recording face is achieved by combining the resin-covered paper substrate, the ink absorption layer principally of fumed silica, and the topmost layer principally of colloidal silica. Because the glossiness of blank portions is 40% or above, a photo medium with a more glossy feel can be realized, whereas if the glossiness exceeded 60%, dazzle would be great and a problem with printed portions being harder to see would arise.

Herebelow, the invention will be more specifically described by Examples. The substance of the invention is not limited to these Examples. Note that 'parts' represents parts by weight of solid components or substantial components.

EXAMPLE 1

Fabrication of a Polyolefin Resin-covered Paper Substrate 1 A 1:1 mixture of broadleaf bleached kraft pulp (LBKP) and broadleaf bleached sulfite pulp (LBSP) was beaten to a Canadian standard freeness of 300 ml to produce a pulp slurry. To this were added 0.5% by pulp weight of alkyl ketene dimer to serve as a sizing agent, 1.0% by pulp weight of polyacrylamide to serve as a reinforcing agent, 2.0% by pulp weight of cationized starch, and 0.5% by pulp weight of polyamide epichlorohydrin resin, and the pulp slurry was diluted with water to form a 1% by weight slurry. This slurry was made into paper with a fourdrinier machine such that a basis weight was 200 g/m$^2$, and this was dried and conditioned to form the base paper of the polyolefin resin-covered paper substrate.

A polyolefin resin composition, in which 10 parts of anatase titanium and 0.06 parts of an fluorescent brightening agent (the aforementioned exemplary compound (2)) had been uniformly dispersed with 100 parts of low-density polyethylene with density 0.918 g/cm$^3$, was melted at 320° C and extrusion-coated to 36 g/m$^2$ onto one face of the above-described base paper. This was extruded for covering, using a cooling roller with a finely roughened surface, to provide a polyolefin resin layer at an ink absorption layer side. A blended resin composition, of 70 parts of high-density polyethylene resin with density 0.962 g/cm$^3$ and 30 parts of low-density polyethylene resin with density 0.918 g/cm$^3$, was melted at 320° C. and extrusion coated to 31 g/m$^2$ onto the opposite face of the base paper. This was extruded for covering, using a cooling roller with a roughened surface, to provide a polyolefin resin layer at a backcoat layer side.

High-frequency corona discharge processing was applied to the one face (the face to which the ink absorption layer was to be applied) of this polyolefin resin-covered paper substrate.

Thereafter, an undercoat layer with the below-described composition was coated such that a gelatin application amount was 50 mg/m$^2$ and dried. High-frequency corona discharge processing was applied to the opposite face of the substrate (the face at which the backcoat was to be applied), and thereafter a backcoat layer with the below-described composition was coated such that a solid content coating amount of polyurethane resin was 1.0 g/m$^2$ and dried. With the polyolefin resin-covered paper substrate to which the undercoat layer and the backcoat layer had been applied in this manner, the MD direction Taber stiffness and whiteness of the polyolefin resin layer at the ink absorption layer side were measured. The results were that the Taber stiffness was 3.7 mN·m and the whiteness was 99%.

| Undercoat Layer | |
|---|---|
| Lime-treated gelatin | 100 parts |
| Sulfosuccinate-2-ethylhexyl ester | 2 parts |
| Chrome alum | 10 parts |

| Backcoat Layer | |
|---|---|
| Polyurethane resin (Tg 60° C.) (HW-350, an ionomer-type polyurethane resin from Dainippon Ink and Chemicals, Incorporated) | 100 parts |
| Surfactant | 0.3 parts |

An ink absorption layer with the below-described composition was coated to a solid content coating amount of 25 g/m$^2$ onto the polyolefin resin-covered paper substrate 1, a colloidal silica containing layer with the below-described composition was coated thereon to a solid content coating amount of colloidal silica of 0.2 g/m$^2$, drying was performed, and an ink jet recording material was fabricated.

Ink absorption layer (A-1)

| | |
|---|---|
| Fumed silica (mean linear particle diameter 7 nm, mean square particle diameter 100 nm) | 100 parts |
| Dimethyl diallyl ammonium chloride homopolymer (SHAROLL DC902P, manufactured by Dai-Ichi Kogyo Seiyaku Co., Ltd., molecular weight 9,000) | 3 parts |
| Polyvinyl alcohol (saponification 88%, mean polymerization 3,500) | 23 parts |
| Thioether-based compound (3,6-dithia-1,8-octanediol) | 3 parts |
| Basic polyhydrated aluminium (PURACHEM WT from Riken Green Co., Ltd.) | 3 parts |
| Boric acid | 4 parts |

These were adjusted with water to a solid content density of 10% by weight.

Colloidal silica containing layer (B-1)

| | |
|---|---|
| PL-3L | 100 parts |

(colloidal silica from Fuso Chemical Co., Ltd., mean linear particle diameter 32 nm) This was adjusted with water to a solid content density of 0.5% by weight.

EXAMPLE 2

An ink jet recording material of Example 2 was fabricated in the same manner as in Example 1, except that a solid content coating amount of the colloidal silicon-containing layer (B-1) of Example 1 was changed to 0.09 g/m$^2$.

EXAMPLE 3

An ink jet recording material of Example 3 was fabricated in the same manner as in Example 1, except that a solid content coating amount of the colloidal silicon-containing layer (B-1) of Example 1 was changed to 0.27 g/m$^2$.

Comparative Example 1

A polyolefin resin-covered paper substrate 2 was fabricated in the same manner as in Example 1, except that the fluorescent brightening agent was not included in the polyolefin resin layer at the ink absorption layer side of the polyolefin resin-covered paper substrate 1 of Example 1, and the undercoat layer and backcoat layer were applied in the same manner. The Taber stiffness of this substrate was 3.7 mN·m and the whiteness was 92%. The ink absorption layer and the colloidal silica layer were provided on this substrate in the same manner as in Example 1, to fabricate an ink jet recording material of Comparative Example 1.

Comparative Example 2

An ink jet recording material of Comparative Example 2 was fabricated in the same manner as in Comparative Example 1, except that the ink absorption layer of Comparative Example 1 was changed to the below-described ink absorption layer (A-2).

Ink absorption layer (A-2)

| | |
|---|---|
| Fumed silica (mean linear particle diameter 7 nm, mean square particle diameter 100 nm) | 100 parts |
| Dimethyl diallyl ammonium chloride homopolymer (SHAROLL DC902P, manufactured by Dai-Ichi Kogyo Seiyaku Co., Ltd., molecular weight 9,000) | 3 parts |
| Polyvinyl alcohol (saponification 88%, mean polymerization 3,500) | 23 parts |
| Thioether-based compound (3,6-dithia-1,8-octanediol) | 3 parts |
| Basic polyhydrated aluminium (PURACHEM WT from Riken Green Co., Ltd.) | 3 parts |
| Boric acid | 4 parts |
| Optical brightening agent (benzimidazole-based) (manufactured by CIBA Specialty Chemicals K.K.) | 0.15 parts |

(manufactured by Ciba Specialty Chemicals K.K.)

These were adjusted with water to a solid content density of 10% by weight.

Comparative Example 3

An ink jet recording material of Comparative Example 3 was fabricated in the same manner as in Example 1, except that the colloidal silica-containing layer (B-1) of Example 1 was not applied.

Comparative Example 4

A polyolefin resin-covered paper substrate 3 was fabricated in the same manner as in Example 1, except that the basis weight of the polyolefin resin-covered paper substrate 1 of Example 1 was altered from 200 g/m$^2$ to 170 g/m$^2$, and the undercoat layer and backcoat layer were applied in the same manner. The Taber stiffness of this substrate was 2.5 mN·m and the whiteness was 98%. The ink absorption layer and the colloidal silica layer were provided on this substrate in the same manner as in Example 1, to fabricate an ink jet recording material of Comparative Example 4.

Comparative Example 5

An ink jet recording material of Comparative Example 5 was fabricated in the same manner as in Example 1, except that the solid content coating amount of the colloidal silica-containing layer (B-1) of Example 1 was altered to 0.5 g/m$^2$.

Comparative Example 6

An ink jet recording material of Comparative Example 6 was fabricated in the same manner as in Example 1, except that the solid content coating amount of the backcoat layer of Example 1 was altered to 0.6 g/m$^2$.

Comparative Example 7

An ink jet recording material of Comparative Example 7 was fabricated in the same manner as in Example 1, except that the ink absorption layer was altered from the ink absorption layer (A-1) of Example 1 to an ink absorption layer (A-3) from which the thioether-based compound was excluded.

Comparative Example 8

An ink jet recording material of Comparative Example 8 was fabricated in the same manner as in Example 1, except that the solid content coating amount of the colloidal silica-containing layer (B-1) of Example 1 was altered to 0.02 g/m$^2$.

The following evaluations were conducted on the ink jet recording materials that had been fabricated as described above. Results are shown in table 1.

Evaluation of High-Quality Feel (Touch Feel and Texture)

A natural image was printed using an ink jet printer for dye-based inks (PM-G800, manufactured by Seiko Epson Corporation). As a reference sample for comparative evaluation, a sample was prepared in which the same natural image was printed on commercially available ink jet paper (tradename "Glossy Photo Paper", type number KA42OPSK from Seiko Epson Corporation). Evaluations of high-quality feel (touch feel and texture) were conducted by 20 randomly selected testees, and judged by the following criteria.

A: At least 15 of the testees rated the high-quality feel (touch feel and texture) over the reference sample C: At least 15 of the testees rated either of touch feel and texture below the reference sample, and therefore did not discern a high-quality feel (touch feel and texture)

Glossiness of Blank Portions (%)

The 20° glossiness was measured with a deflection glossmeter VGS-300A (manufactured by Nippon Denshoku Industries Co., Ltd.) in accordance with JIS-Z8741.

Color Reproduction

Using an ink jet printer for dye-based inks (PM-G800, manufactured by Seiko Epson Corporation), solid areas were printed with respective maximum ink ejection amounts of C, M, Y, K, R, G and B. L*a*b* values of eight colors, a blank portion and these seven colors, were measured with a GRETAG SPECTROLINO calorimeter (manufactured by GretagMacbeth AG). Thereafter, area of an L*a*b* color space (GM: GumatVolume) was calculated using the measured values.

A: The GM value was $5.0\times10^5$ or greater

B: The GM value was from $4.7\times10^5$ to less than $5.0\times10^5$

C: The GM value was less than $4.7\times10^5$

Subdual of Images When Printing Pigment-Based Inks at High Density

Using an ink jet printer for pigment-based inks (PX-G900, manufactured by Seiko Epson Corporation), solid areas were printed on the ink jet recording materials with respective maximum ink ejection amounts of C, M, Y, K, R, G and B. Subdual (dulling, loss of gloss) of the image portions of each color were visually evaluated.

A: Subdual of image portions was not a concern

B: Subdual of image portions was a concern

C: Subdual of image portions was striking

Printer Conveyance Precision

Recording sheets cut to A4 size were stacked in a paper supply tray of the PM-G800 manufactured by Seiko Epson Corporation. Fine lines perpendicular to a conveyance direction of the ink jet recording materials were printed at one-inch intervals, and spacings of the fine lines were measured.

A: Distances between the one-inch fine lines were within ±40 μm

C: Distances between the one-inch fine lines exceeded ±40 μm

Preservation of Blank Portions

Using an ozone generation device, the obtained ink jet recording materials were exposed to 20 ppm for 10 hours, after which states of discoloration of blank portions were visually evaluated by the following criteria.

A: Discoloration was practically undetectable

C: Discoloration was obvious

Preservation of Printed Portions

Cyan, which has the greatest rate of color-fading, was printed to an optical density of 1.0 by an ink jet printer for dye-based inks (PM-970C, manufactured by Seiko Epson Corporation), and exposed to air for three months at room temperature. Thereafter, the optical density of the printed portion was measured, and a retention rate (optical density after exposure/optical density before exposure) was found. The retention rates in Table 1 are percent values.

TABLE 1

| Recording material | High-quality feel | Blank portion glossiness | Color reproduction | Pigment ink image subdual | Printer conveyance precision | Blank portion preservation | Printed portion preservation |
|---|---|---|---|---|---|---|---|
| Example 1 | A | 47 | A | A | A | A | 95 |
| Example 2 | A | 42 | A | A | A | A | 95 |
| Example 3 | A | 57 | A | B | A | A | 95 |

TABLE 1-continued

| Recording material | High-quality feel | Blank portion glossiness | Color reproduction | Pigment ink image subdual | Printer conveyance precision | Blank portion preservation | Printed portion preservation |
|---|---|---|---|---|---|---|---|
| Comparative Example 1 | A | 48 | C | A | A | A | 95 |
| Comparative Example 2 | A | 45 | A | A | A | C | 92 |
| Comparative Example 3 | C | 15 | A | A | A | A | 93 |
| Comparative Example 4 | C | 45 | A | A | A | A | 95 |
| Comparative Example 5 | A | 63 | A | C | A | A | 95 |
| Comparative Example 6 | A | 47 | A | A | C | A | 95 |
| Comparative Example 7 | A | 47 | A | A | A | A | 75 |
| Comparative Example 8 | C | 35 | A | A | A | A | 95 |

From the above-described results, it can be seen that ink jet recording materials of the invention are more excellent in high-quality feel (touch feel and texture), gloss and color reproduction than previous recording materials. Further, with recording materials of the invention, there is very little subdual of images when pigment-based inks are printed at high densities, printer conveyance precision is accurate, and storage stability characteristics of blank portions and printed portions the polyolefin resin-covered paper substrate, color reproduction was not satisfactory. When an fluorescent brightening agent was included in the ink absorption layer (Comparative Example 2), gas resistance of blank portions deteriorated. For Comparative Example 3, in which the colloidal silica-containing layer was not applied, gloss of blank portions was not satisfactory, and texture was poor and a high-quality feel was not obtained. For Comparative Example 4, in which the basis weight of the paper was smaller and the Taber stiffness was insufficient, texture was poor and a high-quality feel was not obtained. For Comparative Example 5, in which the coating amount of the colloidal silica-containing layer was large, subdual of images when pigment-based inks were printed with high densities was great. For comparative example 6, in which the coating amount of the backcoat layer was small, printer conveyance precision was poor. For Comparative Example 7, in which a thioether-based compound was not included in the ink absorption layer, preservation of printed portions was poor. For Comparative Example 8, in which the coating amount of the colloidal silica-containing layer was small, gloss of blank portions was not satisfactory, and touch feel was poor and a high-quality feel was not obtained.

An advantage of some aspects of the invention is that an ink jet recording material is provided which is excellent in high-quality feel (touch feel and texture), gloss, color reproduction, preservation stability of blank portions and printed portions, which has little subdual of images when pigment-based inks are printed at high densities, and which is excellent for printer conveyance precision.

What is claimed is:

1. An ink jet recording material comprising:

a polyolefin resin-covered paper substrate, an MD direction Taber stiffness of which is at least 3 mN·m; an ink absorption layer principally including fumed silica and a layer principally including colloidal silica, in this order at one face of the substrate; and a backcoat layer principally of polyurethane resin at an opposite face of the substrate, wherein the ink absorption layer includes a thioether-based compound, a polyolefin resin layer at a side of the substrate at which the ink absorption layer is to be provided includes an fluorescent brightening agent and a white pigment, a solid content coating amount of the colloidal silica is 0.05 to 0.3 g/m$^2$, a solid content coating amount of the polyurethane resin is 0.8 to 1.5 g/m$^2$, and a 20° glossiness of a blank portion of a face of the recording material that features the ink absorption layer is 40 to 60%.

2. The ink jet recording material according to claim 1, wherein a basis weight of a base paper of the polyolefin resin-covered paper substrate is 190 to 230 g/m$^2$.

3. An ink jet recording material comprising:

a polyolefin resin-covered paper substrate having an MD direction Taber stiffness of at least 3 mN·m, said polyolefin resin-covered paper substrate comprising a base paper and a polyolefin resin layer; an ink absorption layer principally including fumed silica and a gloss layer principally including colloidal silica in this order at a first face of the substrate; and a backcoat layer principally of polyurethane resin at an opposite face of the substrate, wherein the ink absorption layer includes a thioether-based compound in an amount effective to inhibit color-fading in atmosphere of a cyan colorant printed on the recording material, wherein the polyolefin resin layer includes a fluorescent brightening agent and a white pigment, wherein a solid content coating amount of the polyurethane resin is 0.8 to 1.5 g/m$^2$, and wherein a solid content of the colloidal silica in the gloss layer is such that (a) a blank portion of the first face of the recording material has a 20° glossiness of from 42 to 57% and (b) a high density image printed on the first face with a pigment-based ink has a lowered loss of gloss as compared with a loss of gloss exhibited when the high density image is printed with the pigment-based ink on the first face of the recording material with the solid content of the colloidal silica in the gloss layer at 0.5 g/m$^2$, said solid content of the colloidal silica being between 0.05 to 0.3 g/m$^2$.

4. The ink jet recording material according to claim 3, wherein the base paper has a basis weight of 190 to 230 g/m$^2$.

5. The ink jet recording material according to claim 3, wherein the solid content of the colloidal silica is 0.2-0.3 g/m$^2$.

* * * * *

UNITED STATES PATENT AND TRADEMARK OFFICE

CERTIFICATE OF CORRECTION

PATENT NO. : 7,615,266 B2
APPLICATION NO. : 11/384047
DATED : November 10, 2009
INVENTOR(S) : Shuzo Kinoshita et al.

It is certified that error appears in the above-identified patent and that said Letters Patent is hereby corrected as shown below:

On Title Page, Item (73), Assignee: "Eiko" should read --Seiko--.

Signed and Sealed this

Twenty-fifth Day of May, 2010

David J. Kappos

David J. Kappos
*Director of the United States Patent and Trademark Office*